US009975737B2

(12) United States Patent
Zhu et al.

(10) Patent No.: US 9,975,737 B2
(45) Date of Patent: May 22, 2018

(54) HORIZONTALLY MOVABLE VERTICAL SHAFT ROPE GUIDE AND REGULATING METHOD THEREOF

(71) Applicant: CHINA UNIVERSITY OF MINING AND TECHNOLOGY, Xuzhou, Jiangsu (CN)

(72) Inventors: Zhencai Zhu, Jiangsu (CN); Guohua Cao, Jiangsu (CN); Yandong Wang, Jiangsu (CN); Lu Yan, Jiangsu (CN); Weihong Peng, Jiangsu (CN); Yuxing Peng, Jiangsu (CN); Gongbo Zhou, Jiangsu (CN); Wei Li, Jiangsu (CN); Gang Shen, Jiangsu (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days. days.

(21) Appl. No.: 15/520,478

(22) PCT Filed: Dec. 29, 2015

(86) PCT No.: PCT/CN2015/099313
§ 371 (c)(1),
(2) Date: Apr. 20, 2017

(87) PCT Pub. No.: WO2017/092117
PCT Pub. Date: Jun. 8, 2017

(65) Prior Publication Data

US 2017/0305722 A1 Oct. 26, 2017

(30) Foreign Application Priority Data

Dec. 4, 2015 (CN) ..... 2015 1 0886217

(51) Int. Cl.
*B66B 17/00* (2006.01)
*B66B 19/00* (2006.01)
*E21D 7/02* (2006.01)

(52) U.S. Cl.
CPC ..... *B66B 17/00* (2013.01); *B66B 19/00* (2013.01); *E21D 7/02* (2013.01)

(58) Field of Classification Search
CPC ..... B66B 17/00; B66B 19/00; E21D 7/02
See application file for complete search history.

(56) References Cited

U.S. PATENT DOCUMENTS 4,601,607 A * 7/1986 Lehmann ..... E21D 7/02 187/372
4,819,403 A * 4/1989 Penicaut ..... B66B 13/303 33/194

(Continued)

FOREIGN PATENT DOCUMENTS

AU 2014253467 A1 1/2015
CN 201201843 Y 3/2009

(Continued)

*Primary Examiner* — Michael A Riegelman
(74) *Attorney, Agent, or Firm* — Soroker Agmon Nordman PTE Ltd.

(57) ABSTRACT

The present invention relates to a horizontally movable vertical shaft rope guide and a regulating method thereof, which are suitable for guiding of hoisting containers in vertical shafts. The vertical shaft rope guide comprises a hoisting rope, and two hoisting containers suspended from the tail ends of the hoisting rope, wherein, cage guide ropes are led through guide cage lugs arranged on the two sides respectively, a tensioner arranged on the ground at the shaft top is connected to the upper end of each cage guide rope, and a connector arranged under a steel slot at the shaft bottom is connected to the lower end of each cage guide rope; a hydraulic cylinder is connected at the other side of each tensioner and the corresponding connector, and the (Continued)

hydraulic cylinder is connected to the tensioner or connector. During hoisting in the vertical shaft, the hydraulic cylinders are controlled to act in advance, to push the tensioners or connectors to move towards the center between the two hoisting containers, so that the cage guide ropes led through the guide cage lugs on the two sides of the hoisting containers get close to each other at the same time and wrap the hoisting container; thus, the horizontal displacement of the hoisting containers is restrained, and the impact of air flow on the two hoisting containers is minimized when the two hoisting containers meet.

5 Claims, 2 Drawing Sheets

(56) References Cited

U.S. PATENT DOCUMENTS

| | | | | |
|---|---|---|---|---|
| 9,845,605 | B2 * | 12/2017 | Cao | E04G 3/325 |
| 2007/0193823 | A1 * | 8/2007 | Tseng | A62B 1/02 182/3 |
| 2008/0053750 | A1 * | 3/2008 | Tseng | A62B 1/02 182/82 |
| 2013/0118839 | A1 * | 5/2013 | Penn | B66B 11/06 187/262 |
| 2014/0110194 | A1 * | 4/2014 | Zhu | B66B 7/08 187/254 |
| 2015/0122592 | A1 * | 5/2015 | Zhu | B66B 5/24 188/65.1 |
| 2016/0152442 | A1 * | 6/2016 | Weber | B66B 19/00 187/359 |
| 2016/0207740 | A1 * | 7/2016 | Zhu | B66B 17/04 |
| 2016/0251863 | A1 * | 9/2016 | Cao | B66C 13/04 182/19 |

FOREIGN PATENT DOCUMENTS

| | | | |
|---|---|---|---|
| CN | 202499676 | U | 10/2012 |
| CN | 103359645 | A | 10/2013 |
| CN | 204661105 | U | 9/2015 |
| CN | 204661106 | U | 9/2015 |
| JP | 2002018949 | A | 1/2002 |

* cited by examiner

HORIZONTALLY MOVABLE VERTICAL SHAFT ROPE GUIDE AND REGULATING METHOD THEREOF

I. FIELD OF THE INVENTION

The present invention relates to a horizontally movable vertical shaft rope guide and a regulating method thereof, which are especially suitable for guiding of hoisting containers in vertical shafts.

II. BACKGROUND OF THE INVENTION

In some vertical shaft hoisting systems, tensioned steel wire ropes are selected as cage guides for hoisting containers. However, as the depth of vertical shaft increases, even tensioned steel wire ropes may exhibit high flexibility; especially, when the primary hoisting container and the secondary hoisting container meet, the air flow generated by the operation of one container may produce lateral force against the other container; consequently, the containers may have lateral vibration, which has impact on operating smoothness and stability of the hoisting containers.

III. CONTENTS OF THE INVENTION

Technical Problem:

To overcome the drawbacks in the prior art, the present invention provides a horizontally movable vertical shaft rope guide that is simple in structure and operates smoothly and stably, and a regulating method thereof.

Technical Scheme:

To attain the object described above, the horizontally movable vertical shaft rope guide provided in the present invention comprises a hoisting rope, and two hoisting containers that are suspended from the tail ends of the hoisting rope and run up and down alternatively, wherein, guide cage lugs are arranged symmetrically on two sides of each of the hoisting containers, cage guide ropes are led through the guide cage lugs on the two sides respectively, a tensioner arranged on the ground at the shaft top is connected to the upper end of each cage guide rope, and a connector arranged under a steel slot at the shaft bottom is connected to the lower end of each cage guide rope; each tensioner arranged on the ground at the shaft top is opposite to the corresponding connector arranged under the steel slot at the shaft bottom, a hydraulic cylinder is connected at the other side of each tensioner and the corresponding connector, and a piston rod of the hydraulic cylinder is connected to the tensioner or connector.

There are 4 or 8 guide cage lugs arranged symmetrically on the two sides of the hoisting container.

The tensioner and connector comprise a box body for fixing the cage guide ropes in the middle, with rollers arranged symmetrically on the bottom of the box body.

A regulating method of the horizontally movable vertical shaft rope guide described above is as follows: when the two hoisting containers that run up and down alternatively are about to meet, the hydraulic cylinders are controlled to act in advance, to push the tensioners arranged on the ground at the shaft top and the connectors arranged under the steel slot at the shaft bottom, which are opposite to each other, to move towards the center between the two hoisting containers, so that the cage guide ropes that are led through the guide cage lugs arranged on the two sides of the two hoisting containers move towards the center at the same time and apply a lateral force oriented to the center of the vertical shaft on the hoisting containers; thus, the pressure of air flow applied on the two hoisting containers when the two hoisting containers meet is balanced off by the lateral force provided by the cage guide ropes, and thereby the impact of air flow is minimized when the two hoisting containers meet.

The hydraulic cylinders are controlled to act 3-8 seconds in advance.

Beneficial Effects:

With the technical scheme of the present invention described above, in a vertical shaft where steel wire ropes are used as cage guides, the problem of lateral vibration of the two hoisting containers resulted from a force applied to each other owing to air flows generated by the two hoisting containers when the two hoisting containers running up and down meet and the problem of impact on operation smoothness and stability of the hoisting containers are solved. When the two hoisting containers that run up and down are about to meet, the cage guide ropes are regulated in advance to form a wrapping shape for the containers and generate a lateral restraining force; thus, the impact of air pressure is greatly reduced, and the operation smoothness and stability of the hoisting containers is ensured. The horizontally movable vertical shaft rope guide is simple in structures, attains a good effect, operates smoothly and stably, is easy to regulate and maintain, and has wide practicability.

IV. DESCRIPTION OF THE DRAWINGS

Figure 1:
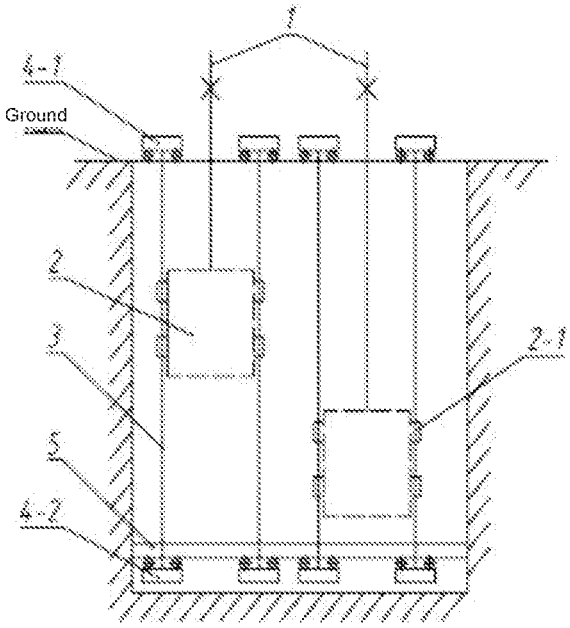
FIG. 1 is a schematic structural diagram of the horizontally movable vertical shaft rope guide according to the present invention.

In the figures: 1—hoisting rope; 2—hoisting container; 2-1—guide cage lug; 3—cage guide rope; 4-1—tensioner 4-2—connector; 4-3—hydraulic cylinder; 4-4—roller; 5—steel slot.

V. EMBODIMENTS

Hereunder one example of the present invention will be further described with reference to the accompanying drawings:

The horizontally movable vertical shaft rope guide provided in the present invention comprises a hoisting rope 1, and two hoisting containers 2 that are suspended from the tail ends of the hoisting rope 1 and run up and down alternatively, wherein, guide cage lugs 2-1 are arranged symmetrically on two sides of each of the hoisting containers 2, cage guide ropes 3 are led through the guide cage lugs 2-1 on the two sides respectively, a tensioner 4-1 arranged on the ground at the shaft top is connected to the upper end of each cage guide rope 3, and a connector 4-2 arranged under a steel slot 5 at the shaft bottom is connected to the lower end of each cage guide rope 3; each tensioner 4-1 arranged on the ground at the shaft top is opposite to the corresponding connector 4-2 arranged under the steel slot 5 at the shaft bottom, a hydraulic cylinder 4-3 is connected at the other side of each tensioner 4-1 and the corresponding connector 4-2, and a piston rod of the hydraulic cylinder 4-3 is connected to the tensioner 4-1 or connector 4-2. There are 4 or 8 guide cage lugs 2-1 arranged symmetrically on the two sides of the hoisting container 2.

The tensioner 4-1 and connector 4-2 comprise a box body for fixing the cage guide ropes 3 in the middle, with rollers 4-4 arranged symmetrically on the bottom of the box body.

A regulating method of the horizontally movable vertical shaft rope guide described above is as follows: when the two hoisting containers 2 that run up and down alternatively are about to meet, the hydraulic cylinders 4-3 are controlled to act in advance, to push the tensioners 4-1 arranged on the ground at the shaft top and the connectors 4-2 arranged under the steel slot 5 at the shaft bottom, which are opposite to each other, to move towards the center between the two hoisting containers, so that the cage guide ropes 3 that are led through the guide cage lugs 2-1 arranged on the two sides of the two hoisting containers 2 move towards the center at the same time and apply a lateral force oriented to the center of the vertical shaft on the hoisting containers 2; thus, the pressure of air flow on the two hoisting containers 2 when the two hoisting containers 2 meet is balanced off by the lateral force provided by the cage guide ropes 3, and thereby the impact of air flow is minimized when the two hoisting containers 2 meet.

The hydraulic cylinders 4-3 are controlled to act 3-8 seconds in advance.

Figure 2:
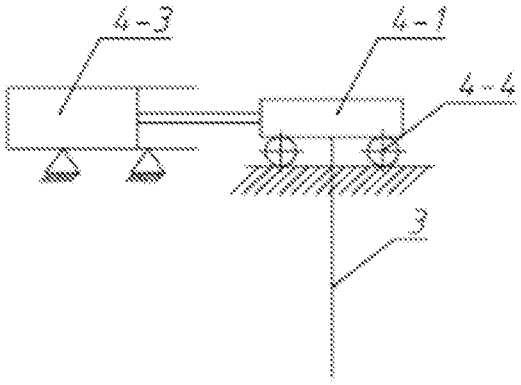
FIG. 2 is a schematic structural diagram of the tensioner according to the present invention.

As shown in FIGS. 1 and 2, a horizontally movable vertical shaft rope guide mainly comprises a hoisting rope 1, two hoisting containers 2 that run up and down, guide cage lugs 2-1, cage guide ropes 3, and tensioners, wherein, the tail ends of the hoisting rope 1 are fixed to the two hoisting containers 2 in the vertical shaft, and the two hoisting containers 2 are suspended by the hoisting rope 1 to move up and down alternatively in the vertical shaft, wherein the two hoisting containers move in opposite direction. The guide cage lugs 2-1 are arranged symmetrically on the two sides of the hoisting container 2, cage guide ropes 3 are led through the guide cage lugs 2-1 on the two sides respectively, the cage guide ropes 3 are tensioned up and then fixed at two sides of the hoisting container 2, and the hoisting container 2 runs along the cage guide ropes 3; thus, a guiding function is provided. A tensioner 4-1 arranged on the ground at the shaft top is connected to the upper end of each cage guide rope 3 led through the guide cage lugs, and a connector 4-2 arranged under a steel slot 5 at the shaft bottom is connected to the lower end of each cage guide rope 3; each tensioner 4-1 arranged on the ground at the shaft top is opposite to the corresponding connector 4-2 arranged under the steel slot 5 at the shaft bottom, a hydraulic cylinder 4-3 is connected at the other side of each tensioner 4-1 and the corresponding connector 4-2, and a piston rod of the hydraulic cylinder 4-3 is fixedly connected to the tensioner 4-1 or connector 4-2. The tensioner 4-1 and connector 4-2 comprise a box body for fixing the cage guide ropes 3 in the middle, with rollers 4-4 arranged symmetrically on the bottom of the box body. Four or eight guide cage lugs 2-1 are arranged symmetrically on the two sides of the hoisting container 2, depending on the specific circumstance; preferably eight guide cage lugs 2-1 are provided, i.e., four guide cage lugs 2-1 on each side of the hoisting containers, wherein the guide cage lugs are arranged symmetrically in both vertical and horizontal directions.

Figure 3:
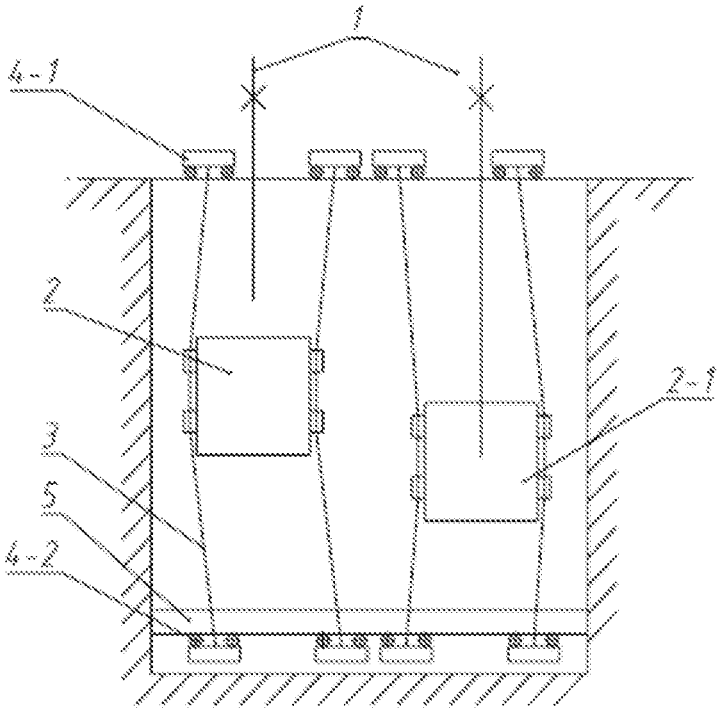
FIG. 3 is a schematic structural diagram showing how a wrapping shape is formed for the hoisting containers according to the present invention.

As shown in FIG. 3, a regulating method of the horizontally movable vertical shaft rope guide described above is as follows: eight guide cage lugs 2-1 are arranged symmetrically on the two sides of the hoisting containers 2; upon vertical shaft hoisting, when the two hoisting containers 2 that run up and down alternatively are about to meet, the hydraulic cylinders 4-3 are started and are controlled to act 3-8 seconds in advance, so that the tensioners 4-1 or corresponding connectors 4-2, which are opposite to each other, are pushed to move towards the center between the two hoisting containers, the cage guide ropes 3 led through the guide cage lugs 2-1 arranged on the two sides of the hoisting containers get close to each other, and wrap the hoisting containers 2; thus, the horizontal displacement of the hoisting containers 2 is restrained, and the impact of air flows on the two hoisting containers is minimized when the two hoisting containers meet.

The guide cage lugs 2-1 are arranged around the hoisting containers 2, and the cage guide ropes 3 are led through the guide cage lugs 2-1; thus, the hoisting containers 2 run along the cage guide ropes 3, and a guiding function is provided. The tensioners 4-1 are arranged as tensioning device for the cage guide ropes 3 at the shaft top, and the connectors 4-2 are arranged at the shaft bottom.

The invention claimed is:

1. A rope guide system that is configured to be horizontally moveable in a vertical shaft that extends downward from a ground level, comprising:

a hoisting rope (1) having two tail ends;

two hoisting containers (2); a first hoisting container and a second hoisting container (2) that are each suspended from one of the tail ends of the hoisting rope (1); wherein the first hoisting container (2) and the second hoisting container (2) are arranged, so that when the first hoisting container (2) runs up vertically in the vertical shaft the second hoisting container (2) run down vertically in the vertical shaft and when the second hoisting container (2) runs up vertically in the vertical shaft the first hoisting container (2) runs down vertically in the vertical shaft;

cage guide ropes (3) that extend from a top of the vertical shaft to a bottom of the vertical shaft guide motion of the hoisting containers (2);

tensioners (4-1) positioned on the ground level at the top of the vertical shaft connected to a top end of each of the cage guide ropes (3);

connectors (4-2) positioned at the bottom end of the vertical shaft connected to a bottom end of each of the cage guide ropes (3), each connector (4-2) having a corresponding tensioner (4-1) connected to an opposite side of the cage guide rope (3);

a steel slot (5) at the bottom of the vertical shaft for holding the connectors (4-2) underneath the steel slot (5) at the bottom of the vertical shaft;

wherein each of the hoisting containers (2) comprises guide cage lugs (2-1) that are arranged symmetrically on two opposite sides of each of the hoisting containers (2); the cage guide ropes (3) are configured to be led through the guide cage lugs (2-1) on the two opposite sides respectively to guide the hoisting containers (2);

wherein hydraulic cylinder (4-3) is connected to a side of each connector (4-2) and each of the corresponding tensioners (4-1); and wherein each hydraulic cylinder (4-3) is configured to move the tensioners (4-1) and the connectors (4-2) horizontally toward a center of the vertical shaft between the first hoisting container (2) and the second hoisting container (2) when the two hoisting containers (2) are about to pass each other while moving in opposite directions in the vertical shaft, so that the cage guide ropes (3) that are led through the guide cage lugs (2-1) arranged on the two opposite sides of the hoisting containers (2) move horizontally toward the center simultaneously and apply a lateral force oriented to the center of the vertical shaft on the hoisting containers (2)

to counteract air flow pressure on the two hoisting containers (2) when the two hoisting containers (2) pass each other.

2. The system according to claim 1, wherein, there are 4 or 8 guide cage lugs (2-1) arranged symmetrically on the two opposite of the hoisting container (2).

3. The system according to claim 1, wherein, the tensioner (4-1) and connector (4-2) comprise rollers (4-4) arranged symmetrically on a bottom of the tensioner (4-1) and connector (4-2) to enable the tensioner (4-1) and connector (4-2) to move horizontally towards the center simultaneously.

4. A regulating method of a rope guide system, comprising:

a) providing a rope guide system comprising:

a hoisting rope (1) having two tail ends;

two hoisting containers (2); a first hoisting container and a second hoisting container (2) that are each suspended from one of the tail ends of the hoisting rope (1); wherein the first hoisting container and the second hoisting container are arranged so that when the first hoisting container (2) runs vertically in the vertical shaft the second hoisting container (2) runs down vertically in the vertical shaft and when the second hoisting container (2) runs up vertically in the vertical shaft the first hoisting container (2) runs down vertically in the vertical shaft;

cage guide ropes (3) that extend from a top of the vertical shaft to a bottom of the vertical shaft to guide motion of the hoisting containers (2);

tensioners (4-1) positioned on the around level at the top of the vertical shaft connected to a top end of each of the cage guide ropes (3);

connectors (4-2) positioned at the bottom of the vertical shaft connected to a bottom end of each of the cage guide ropes (3), each connector (4-2) having a corresponding tensioner (4-1) connected to an opposite side of the cage guide rope (3);

a steel slot (5) at the bottom of the vertical shaft for holding the connectors (4-2) underneath at the bottom of the vertical shaft;

wherein each of the hoisting container (2) comprises guide cage lugs (2-1) that are arranged symmetrically on two opposite sides of each of the hoisting containers (2); the cage guide ropes (3) are configured to be led through the guide cage lugs (2-1) on the two opposite sides respectively to guide the hoisting containers (2);

b) connecting a hydraulic cylinder (4-3) to each connector (4-2) and each of the corresponding tensioners (4-1);

c) when the two hoisting containers (2) are about to pass each other while moving in opposite directions in the vertical shaft controlling the hydraulic cylinders (4-3) to move the tensioners (4-1) and the connectors (4-2) horizontally toward a center of the vertical shaft between the first hoisting container (2) and the second hoisting container (2), so that the cage guide ropes (3) dual are led through the guide cage lugs (2-1) arranged on the two opposite sides of the two hoisting containers (2) move towards the center simultaneously and apply a lateral force oriented to the center of the vertical shaft on the hoisting containers (2) to counteract air flow pressure of the two hoisting containers (2) when the two hoisting containers (2) pass each other.

5. The regulating method of claim 4, wherein, the hydraulic cylinders (4-3) a controlled to act 3-8 seconds in advance of the two hoisting containers (2) passing each other.

* * * * *